United States Patent [19]

Grigoriev et al.

[11] 3,980,142

[45] Sept. 14, 1976

[54] DRILLING BOOM

[76] Inventors: Vladimir Konstantinovich Grigoriev, 1 Streletsky pereulok, 3, kv. 24, Moscow; Viktor Dmitrievich Chugunov, poselok 2, dom 4, kv. 13, Moskovskaya oblast, Solnechnogorsky raion; Alexandr Moiseevich Tsipkis, Ananievsky pereulok, 4/2, kv. 121, Moscow; Mikhail Nikolaevich Kudryakov, ulitsa Zholtovskogo, 27, kv. 10, Moscow; Vladimir Germogenovich Yakovlev, proezd Kirova, 6a, kv. 7, Moscow; Vladimir Borisovich Tumarkin, ulitsa Markhlevskogo, 3, kv. 26, Moscow; Jury Borisovich Bashilov, ulitsa Suvorova, 12; Jury Mikhailovich Kulaev, prospekt Mira, 9, kv. 3, both of Dzhezkazgan; Vladimir Yakovlevich Feldman, Nakhimovsky prospekt, 39, korpus 2, kv. 57, Moscow; Vyacheslav Fedorovich Semikozov, Vishnyakovskaya ulitsa, 6, korpus 5, kv. 29, Moscow; Viktor Ivanovich Badin, ulitsa Chertanovskaya, 29, korpus 2, kv. 85, Moscow; Vladislava Vladislavovna Sheveleva, ulitsa Chertanovskaya, 52, korpus 1, kv. 71, Moscow, all of U.S.S.R.

[22] Filed: Sept. 10, 1975

[21] Appl. No.: 611,926

[52] U.S. Cl. ..... 173/43; 248/16

[51] Int. Cl.[2] ..... E21C 11/00; E21C 5/08

[58] Field of Search ..... 173/42, 43, 44, 38; 248/16; 212/55

[56] References Cited

UNITED STATES PATENTS

| | | | |
|---|---|---|---|
| 3,338,316 | 8/1967 | Thompson | 248/16 |
| 3,523,336 | 8/1970 | Kimber | 248/16 |
| 3,711,047 | 1/1973 | O'Leary | 173/43 |
| 3,923,276 | 12/1975 | Kimber | 173/43 |

*Primary Examiner*—James A. Leppink

*Attorney, Agent, or Firm*—Holman & Stern

[57] ABSTRACT

The herein-proposed drilling boom is provided with a telescopic manipulator mounted with its one end on the bearing plate with a possibility to turn round the vertical axis while hinged to its other end is a feed with drifter, said feed being provided with a crowd hydraulic cylinder. Besides, rigidly secured on the vacant end of the manipulator is a head carrying the hydraulic cylinders for tilting and turning the feed in a horizontal plane and a rotational mechanism adapted to turn the feed round the axis of the rotational mechanism. The drilling boom is also provided with hydraulic cylinders for lifting and turning the manipulator in a horizontal plane. The peculiar constructional feature of this drilling boom lies in the fact that its manipulator-actuating hydraulic cylinder and the feed crowd cylinder are controlled by the respective servomechanisms, each of said servomechanisms being provided with a servodrive having a rod coaxially mounted on which are hydraulic cylinders the rod-end space or piston-end space of each of said cylinders communicating with the respective rod-end space or piston-end space of the hydraulic cylinder controlled by the servomechanism said spaces being equal in volume.

3 Claims, 10 Drawing Figures

DRILLING BOOM

The present invention relates to drilling booms secured on a drilling carriage or on a drilling rig and used in driving mine openings and in stoping.

The known drilling boom comprises a telescopic manipulator (also referred to as a telescopic drill) with its actuating hydraulic cylinder, said manipulator being hinged with its one end to a pier column mounted on a bearing plate with a possibility to turn round its own axis. Hinged to a vacant end of the telescopic manipulator is a feed with a drifter, said feed being provided with a crowd hydraulic cylinder. Rigidly fixed to this vacant end of the telescopic manipulator is a head carrying hydraulic cylinders for tilting and swivelling the feed in a horizontal plane as well as a rotational mechanism to turn the feed round the axis of the rotational mechanism which axis is parallel to that of the feed.

Change of the angle of inclination of the telescopic manipulator in a vertical plane is accomplished by means of the hydraulic cylinder whose rod with its vacant end is hinged to the manipulator, while its body is articulated to the pier column.

Change of the angle of turn of the telescopic manipulator in a horizontal plane is accomplished by means of the hydraulic cylinder whose rod with its vacant end is articulated to the bearing plate.

A disadvantage of the known drilling boom resides in a deviation of the operating end of the manipulator from the face.

This occurs when changing both the angle of inclination of the telescopic manipulator in a vertical plane and the angle of turn of said manipulator in a horizontal plane.

Setting the feed business end in alignment with the hole is rather laborious and time-consuming operation.

It is an object of the present invention to provide such a drilling boom that would automatically compensate for deviation of the end of the manipulator from the face, while swinging the telescopic manipulator.

It is another object of the present invention to provide such a drilling boom that would make it possible to attain a simultaneous holing.

Said and other objects of the present invention are achieved due to the fact that the herein-proposed drilling boom comprises a telescopic manipulator whose one end is hinged to a pier column mounted on a bearing plate, said manipulator incorporating an actuating hydraulic cylinder and being vertically tiltable, said manipulator vacant end being also furnished with a head fixed to its vacant end, said head carrying hydraulic cylinders for tilting and turning the feed in a horizontal plane and a rotational mechanism for turning the feed round the axis of said mechanism, which is parallel to that of the feed, and hydraulic cylinders for lifting and turning the manipulator in a horizontal plane, one end of each of said hydraulic cylinders being hinged to the column while the other ends of said cylinders is hinged as follows: one end, to the manipulator, the other, to the bearing plate. According to the invention, at least one of the two hydraulic cylinders, one of them being a telescopic manipulator actuating cylinder, while the other is a feed crowd cylinder, is actuated by a servomechanism having a drive provided with a rod, coaxially mounted on which are a hydraulic cylinder whose rod-end space or piston-end space communicates with the rod-end space or piston-end space of the hydraulic cylinder controlled by the servomechanism, said spaces being equal in volume; a servopiston having a body with a duct along which working fluid (oil) is fed in that servopiston, and ducts along which working fluid is fed respectively into the piston-end space or rod-end space of the servomechanism drive hydraulic cylinder, into the piston-end space or rod-end space of the hydraulic cylinder controlled by the servomechanism as well as ducts along which working fluid is returned from the above-mentioned spaces, and a plunger; the rod of the servomechanism drive hydraulic cylinder is rigidly connected with the body of the servopiston and, depending on the rod position with respect to the plunger, one of said ducts are communicated with the duct along which working fluid is fed into the servopiston, whereas the other duct is communicated with one of the return ducts, and a link motion kinematically coupling the drive of the servomechanism with the telescopic manipulator so that turning the telescopic manipulator will cause the body of the drive hydraulic cylinder with its rod to displace alongside with the servopiston body with respect to the plunger, thus communicating the duct along which working fluid is fed into the servopiston with one of the spaces of the actuated hydraulic cylinder, thereby either extending or retracting its rod and thus compensating for deviation of the end of the manipulator from the face.

It is expedient that the servomechanism drive by secured on the manipulator, with the or piston-end space rod-end space of the manipulator actuating hydraulic cylinder communicating with the respective rod-end space or piston-end space of the servomechanism drive hydraulic cylinder, and that the link motion be provided with a slide black. In this case a vertical travel of the manipulator will cause the slide black to move along the guideways alongside with the body of the servomechanism drive hydraulic cylinder.

It is also reasonable that the servomechanism drive be secured on the bearing plate, with the piston-end space or rod-end space of the feed crowd hydraulic cylinder communicating with the respective space of the servomechanism drive hydraulic, cylinder, the link motion be provided with a tie rod hinged to the servomechanism drive hydraulic cylinder body, said link motion being secured on a pier column by means of a lever. In this case a horizontal travel of the manipulator will cause the tie rod to move with respect to the axis of the pier column alongside with the body of the servomechanism drive hydraulic cylinder.

According to the present invention, a drilling boom is provided, which is capable to compensate for the deviation of the end of the manipulator from the face.

Other object and essential advantages of the herein-disclosed invention will hereinafter become more evident from a detailed description of an exemplary embodiment thereof with due reference to the accompanying drawings, wherein.

Figure 1:
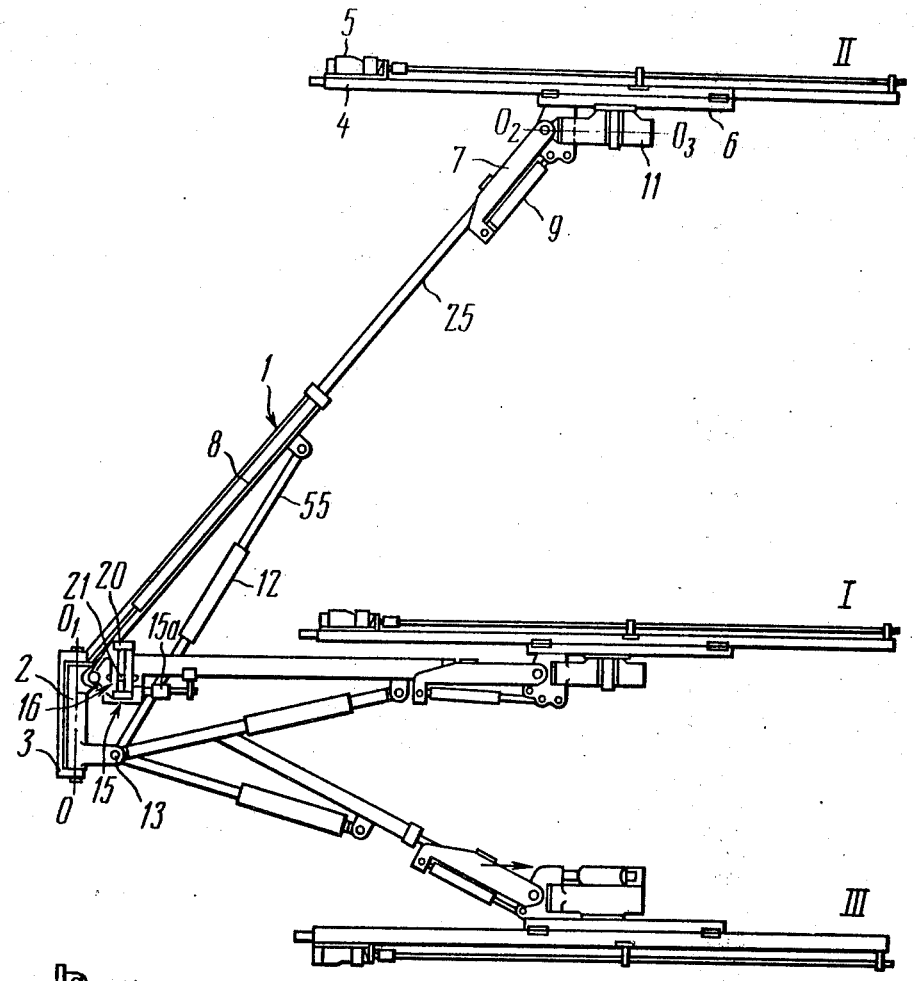
FIG. 1 is a general schematic view of a drilling boom, according to the invention, while in a horizontal lifted (II) and lowered (III) positions.
Figure 2:
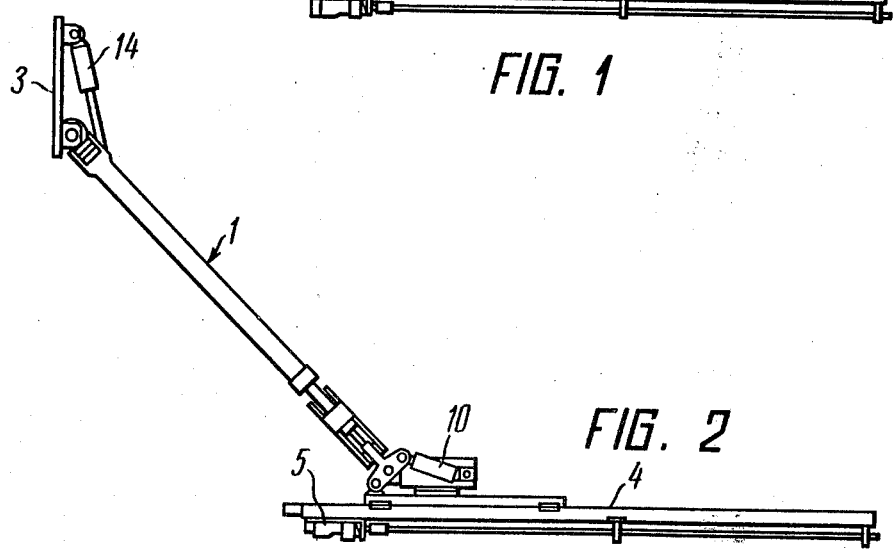
FIG. 2 is a plan view of FIG. 1.

The drilling boom comprises a telescopic manipulator 1 whose one end is secured on a pier column 2 mounted on a bearing plate 3 with a possibility to turn round a vertical axis $00_1$. Hinged to the vacant end of the telescopic manipulator 1 is a feed 4 with a drifter 5. The feed 4 incorporates a crowd hydraulic cylinder 6 and is coupled with a head 7 rigidly fixed to said vacant end of the manipulator. The manipulator accommodates its actuating hydraulic cylinder 8. The head 7 is provided with a hydraulic cylinder 9 for tilting the feed 4 and a hydraulic cylinder 10 (FIG. 2) for turning the feed 4. The head also carries a rotational mechanisms 11 (FIG. 1). The rotational mechanism 11 is adapted to turn the feed through and angle of up to 180° with respect to an axis $0_20_3$ parallel to that of the feed 4. Provision of such a turn of the feed makes it possible to carry out drilling operations in a line hole face at a minimum distance from the rock, walls and roof of a mine opening and, moreover, almost fully excludes a 'dead zone' on the face, with parallel holes drilled therein. The drilling boom is also provided with a hydraulic cylinder 12 adapted to lift the telescopic manipulator and hinged with its one end to said manipulator, while its other end is secured on the pier column 2 by means of a joint 13. Besides, the drilling boom incorporates a hydraulic cylinder 14 (FIG. 2) for turning the telescopic manipulator in a horizontal plane.

The drilling boom is provided with a servomechanism 15 adapted to initiate the telescopic manipulator actuating cylinder. The servomechanism 15 incorporates a drive 15*a* secured on the telescopic manipulator 1 and a link motion 16.

The drilling boom also carries a servomechanism 17 (FIG. 3) which is similar in design to the servomechanism 15 and is adapted to initiate the crowd hydraulic cylinder of the feed 4, said servomechanism 17 incorporating a drive 17*a* secured on the bearing plate 3 and a link motion 18.

Figure 4:
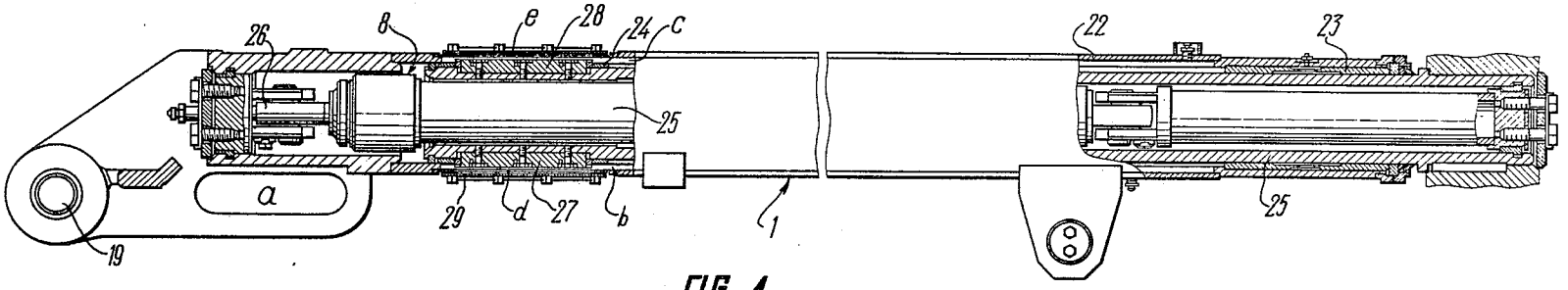
FIG. 4 is a longitudinal section view of a drilling boom manipulator.
Figure 5:
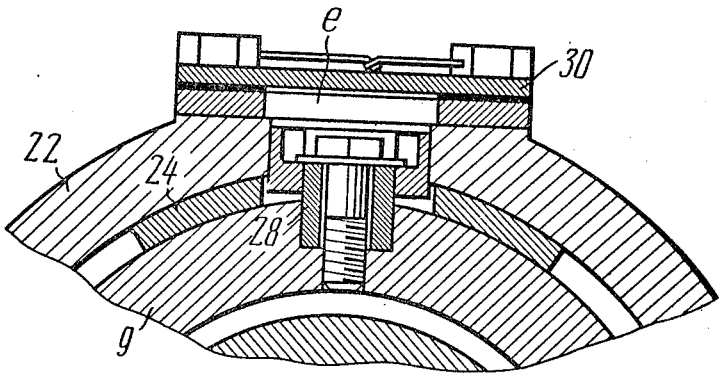
FIG. 5 is a cross-section taken along V — V in FIG. 4.

The telescopic manipulator 1 (FIG. 4), accommodating the actuated hydraulic cylinder 8, is provided with an eye 19 and a groove *a* made to suit the shape of a guideway 20 (FIG. 1). The guideways 20 are rigidly fixed to the pier column and form part of the link motion 16 of the servomechanism 15. The guideways 20 mount a slide block 21 which is rigidly fixed to the hydraulic cylinder of the servomechanism and form the other part of the link motion 16. The telescopic manipulator comprises a body 22 (FIG. 4). The actuated hydraulic cylinder 8 incorporates bronze bushes 23 and bronze liners 24 FIG. 4 and 5 which seal its rod 25. The actuated hydraulic cylinder 8 is connected with the body 22 of the telescopic manipulator 1 by means of its rod 25, the body 22 being coupled in turn with a rod 26. The rod 25 is held against turning by means of keys 27 and 28 housed in grooves *b* and *c* of the body 22. The body 22 is provided with assembly ports *d* (FIG. 4) and *e* (FIG. 5) normally closed with covers 29 (FIG. 4) and 30 (FIG. 5).

Figure 6:
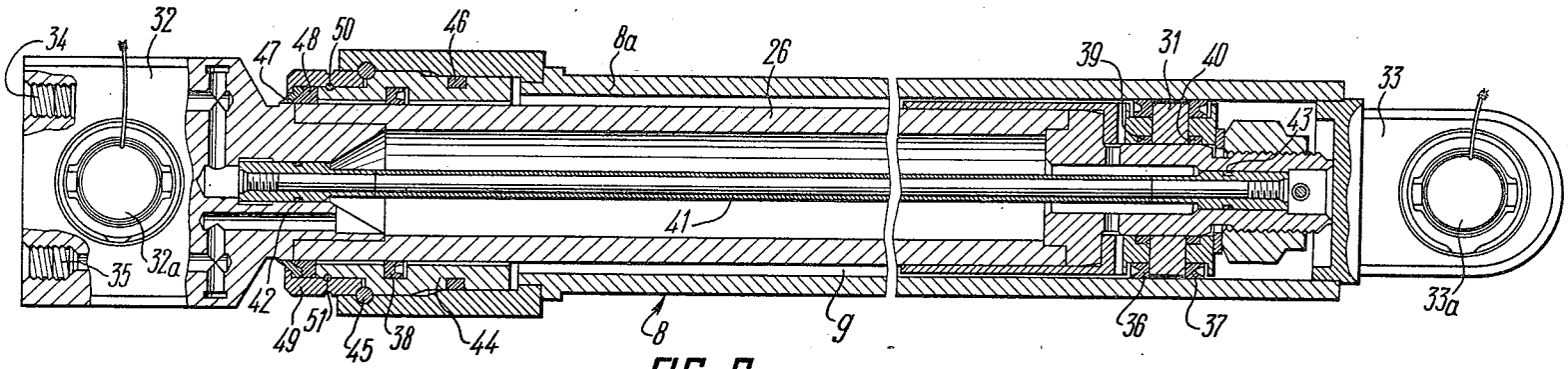
FIG. 6 is a longitudinal section view of a manipulator actuating hydraulic cylinder.

A body 8*a* (FIG. 6) of the actuated hydraulic cylinder of the telescopic manipulator 1 accommodates the rod 26 with a piston 31 fixed to it. A support 32 with an eye 32*a* is welded to the rod 26, while a support 33 with an eye 33*a* is welded to the body 8*a*. The working fluid (oil) is fed to a piston-end space *f* and to a rod-end space *g* through the respective inlets 34 and 35 provided in the support 32. Sealing of working spaces *f* and *g* is effected by means of collars 36, 37 and 38. The piston 31 on the rod 26 is sealed by means of rubber rings 39 and 40. From the inlet 34 the oil flows to the space *f* via a pipe 41 sealed with rubber rings 42 and 43. A bush 44 is held in the body 8*a* with the help of a rubber ring 46. Mud removers 47 and 48 are secured by means of a cover 49 and cotter pins 50 and 51.

The servomechanisms 15 and 17 can be used on the drilling booms of any type and, particularly, on the drilling booms adapted to maintain the parallelism of the feed motion and operating on the principle of hydraulic parallelogram.

Figure 7:
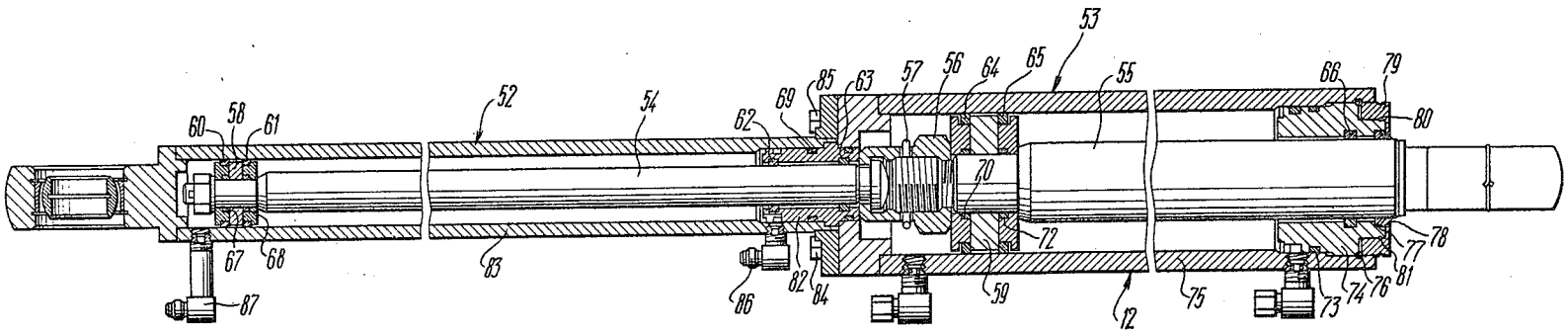
FIG. 7 is a longitudinal section view of a manipulator lift hydraulic cylinder.

In the present drilling boom the hydraulic cylinder 12 adapted for lifting the telescopic manipulator 1 comprises a pilot cylinder 52 (FIG. 7) employed in the hydraulic parallelogram circuit, and a hydraulic cylinder 53 adapted to lift the telescopic manipulator in a vertical plane. Rods 54 and 55 of hydraulic cylinders 52 and 53 are interconnected by means of nut 56 fixed on the rod 55 with a cotter pin 57 retaining said nut against spontaneous unscrewing. Pistons 58 and 59 are secured on the rods 54 and 55.

Sealing of the spaces of the hydraulic cylinder 52 is effected by means of collars 60 through 66 and rubber rings 67 through 73. A bush 74 is held in a body 75 by means of a snap ring 76. Mud removers 77 and 78 are retained with a cover 79 and cotter pins 80 and 81. A bush 82 is secured between the body 75 and a body 83 interconnected with bolts 84 and 85. Rod-end and piston-end spaces of the pilot cylinder 52 are hydraulically intercommunicated through connections 86 and 87 with the respective spaces of the hydraulic cylinder 9 (FIG. 1) adapted to tilt the feed 4 and are equal in volume with the spaces of said hydraulic cylinder.

Provision of the hydraulic cylinder 12 for lifting the telescopic manipulator 1 and the hydraulic cylinder 9 adapted for tilting the feed 4 and hinged with its one end with the telescopic manipulator 1 and with its other end, with the feed 4, makes it possible, while swinging the telescopic manipulator, to attain the parallelism in the feed vertical motion, i.e., said cylinders ensure operation on the principle of hydraulic parallelogram.

Figure 8:
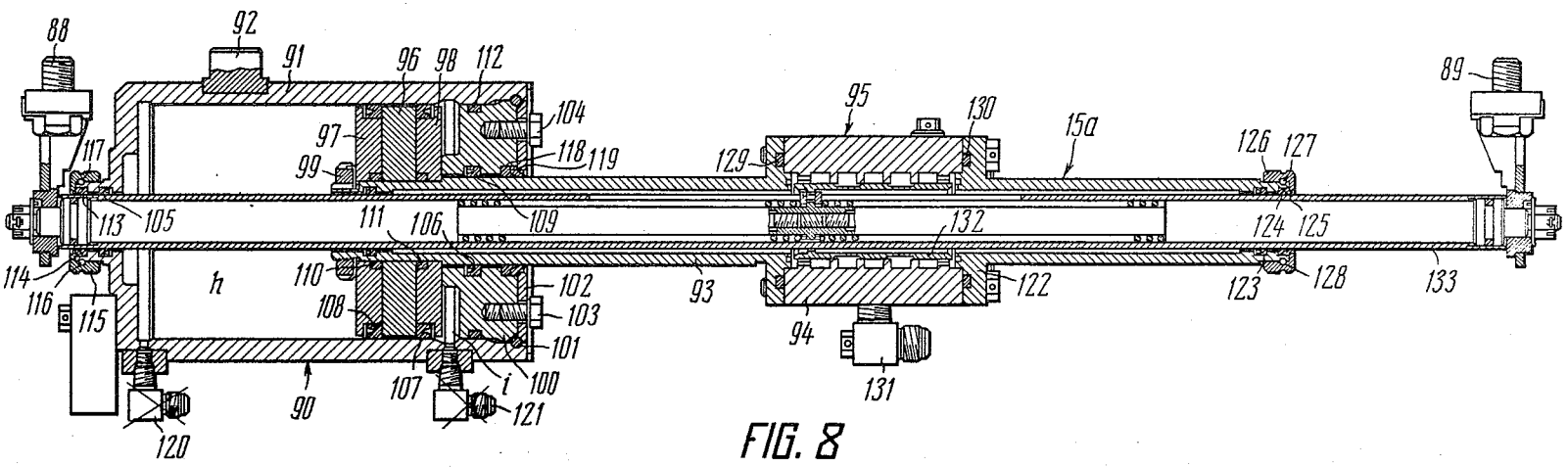
FIG. 8 is a longitudinal section view of a servomechanism drive.

A drive 15*a* of the servomechanism 15 is secured on the body of the telescopic manipulator 1 by means of brackets 88 and 89 (FIG. 8). The drive 15*a* incorporates a cylinder 90, whose body 91 is connected with the slide black 21 (FIG. 1) through a dowel pin 92. A hydraulic cylinder 90 incorporates a piston-end space *h* and a rod-end space *i* intercommunicated with the rod-end space *g* (FIG. 6) of the actuating hydraulic cylinder 8 of the telescopic manipulator 1. The rod-end space *i* of the hydraulic cylinder 90 of the drive (15*a*) of the servomechanism 15 and the piston-end space *g* of the actuating hydraulic cylinder (8) of the telescopic manipulator are equal in volume. The body of a servopiston 95 is secured on the vacant end of rod 93 (FIG. 8) of the hydraulic cylinder 90. The body 91 of the actuating hydraulic cylinder 90 accommodates a composite rod 96 provided with rings 97 and 98 and secured on a rod 93 with a nut 99. A cover 100 of the hydraulic cylinder is fixed in the body 91 by means of a snap ring 101, washer 102, and bolts 103 and 104. Sealing of the spaces along the rod is effected by means of collars 105 through 109 and rubber rings 110 through 112. Mud removers 113 and 114 are secured in the body 91 by means of a cover 115 and cotter pins 116 and 117, while mud removers 118 and 119 are secured by means of a cover 100 and a washer 102. The hydraulic cylinder 90 incorporates connections 120 and 121. A cover 122 of the servopiston 95 accommodates a collar 123 and mud removers 124 and 125 fixed by means of a cover 126 and cotter pins 127 and 128. The body 94 of the servopiston 95 is sealed by means of rubber rings 129 and 130, said body being provided with a connection 131 adapted for feeding the working fluid into the servopiston. The servopiston 95 comprises a plunger 132 mounted on a rod 135.

Figure 9:
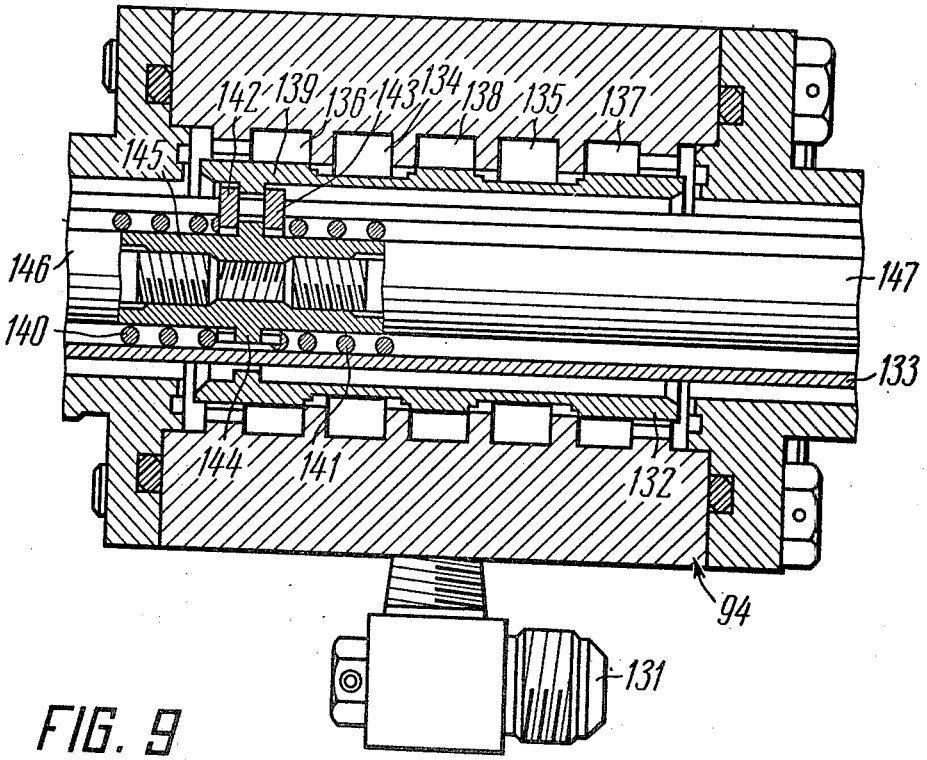
FIG. 9 is a longitudinal section view of a servomechanism drive servopiston.

A body 94 (FIG. 9) is provided with a duct 134 to feed the working fluid into the piston-end space *h* (FIG. 8) of the hydraulic cylinder 90 of the drive 15*a* of the servomechanism 15; a duct 135 (FIG. 9) to feed the working fluid into the rod-end space *f* (FIG. 10) of the telescopic manipulator seconary actuating hydraulic cylinder, ducts 136 and 137 (FIG. 9) to return the working fluid from said ducts and a duct 138 to feed the working fluid into the servopiston. The plunger 132 has a shoulder 139 which together with springs 140 and 141 and shaped washers 142 and 143 retain the plunger in a fixed position with respect to a rod 133. The shaped washers 142 and 143 bear against a shoulder 144 of a bush 145 coupling together two rods 146 and 147 housed in a rod 133 (FIGS. 8, 9).

Figure 3:
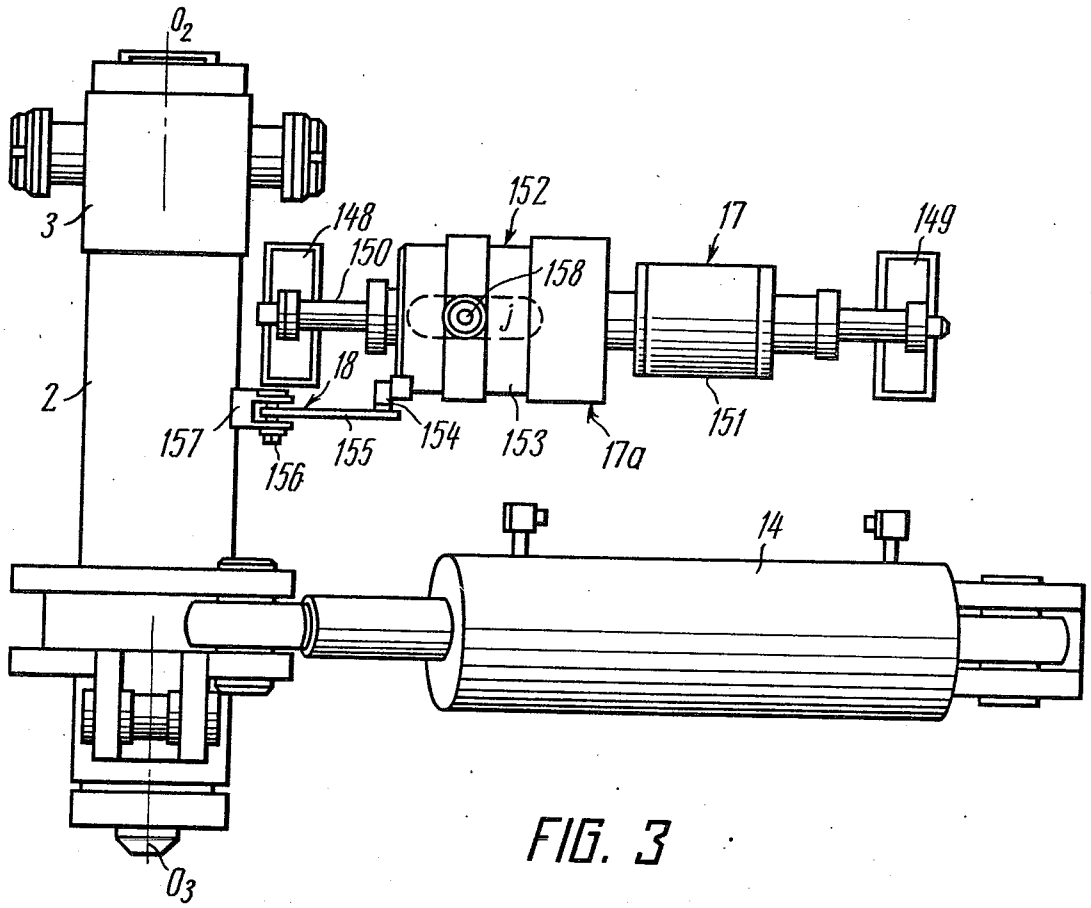
FIG. 3 shows a bearing plate with a pier column, manipulator actuating hydraulic cylinder and servomechanism drive.

The servomechanism 17 shown in FIG. 3 is intended to compensate for the deviation of the business end of feed 4 (FIG. 2) from the face when varying the angle of turn of the telescopic manipulator 1 in a horizontal plane, said servomechanism being connected with the feed crowd hydraulic cylinder 6. The drive 17*a* (FIG. 3) of the servomechanism 17 is secured on the bearing plate by means of brackets 148 and 149 and is provided with a rod 150, coaxially mounted on which are a servopiston 151 and a hydraulic cylinder 152 whose body 153 is connected with a tie rod 155 of a link motion 18 through a joint 154. The tie rod 155 is connected through a joint 156 with a lever 157 rigidly secured on the pier column 2. A body 158 is held against turning round its longitudinal axis with the help of a roller 158 secured on said body, said roller being located in a groove *j* of said body.

The rod-end space of the hydraulic cylinder 152 of the drive 17*a* communicates with the rod-end space of the actuated crowd hydraulic cylinder 6 (FIG. 1) of the feed 4 and is equal in volume with the latter space.

The herein-proposed drilling boom operates as follows. When operating in the mode of automatic compensation for deviation of the feed business end, resulting from vertical displacement of the manipulator, a distributor 163 is put into operation from a control desk (not shown) having distributors 159, 162 and 163 (FIG. 10) so as to admit oil feed into a duct 138 (FIG. 9) of a servopiston 95. If the duct 138 is shut with the plunger 132, the oil ceases flowing into the hydraulic cylinder 8 of the telescopic manipulator 1.

Figure 10:
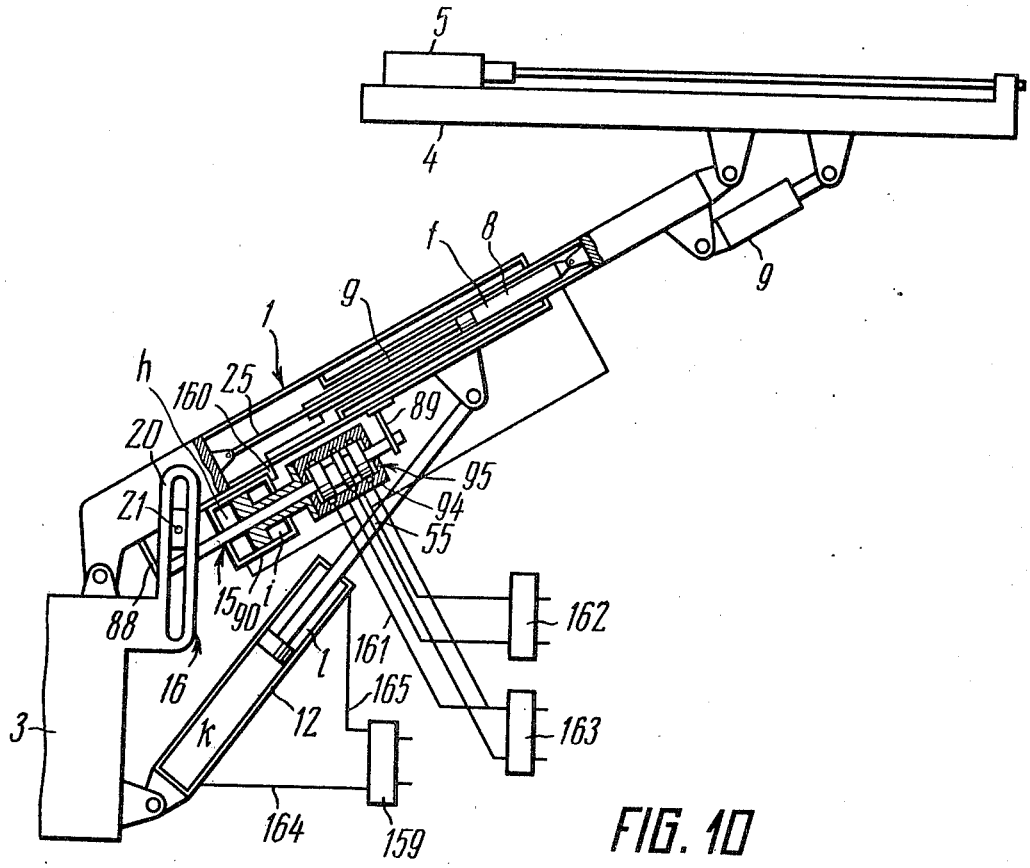
FIG. 10 is a technological diagram of a drilling boom, according to the invention.

To make the telescopic manipulator move vertically, the distributor 159 (FIG. 10) is put into operation from the control desk (not shown), with the distributor 163 turn on. Oil from the oil line (not shown) is fed through the distributor 159 into a piston-space *k* or into a rod-end space *l* of the hydraulic cylinder 12 adapted for lifting the telescopic manipulator 1. Upon feeding the oil into the piston-end space *k* of the hydraulic cylinder 12, its rod 55 extends and turns the telescopic manipulator clockwise with respect to the bearing plate 3. As a result, the slide block 21 of the link motion 16 of the servomechanism 15, sliding up over the guideways 20, displaces the hydraulic cylinder 90 together with the body 94. (FIG. 5) of the servopiston 95 with respect to the plunger 132 towards the bracket 89, with the result that the oil from the oil line (not shown) starts flowing along the duct 138 into the duct 135 communicated with the piston-end space *f* of the hydraulic cylinder 8, thus extending the latter and increasing the length of the telescopic manipulator 1. As a result, the space *h* of the hydraulic cylinder 90 gets communicated through the duct 134 with the duct 136 which is communicated with the return line through a pipeline 161. With the hydraulic cylinder 8 extended, the oil expelled from the rod-end space *g* of the actuating hydraulic cylinder of the telescopic manipulator 1 gets into the rod-end space *i* of the hydraulic cylinder 90 along the pipeline 160 and displaces the cylinder rod 93 (FIG. 8) together with the body 94 of the servopiston 95, with respect to the plunger 132, to the initial position towards the bracket 83. As a result, the duct 138 (FIG. 9) gets shut off and the working fluid ceases flowing to the duct 135 and to the piston-end space *f* of the actuating hydraulic cylinder 8 of the telescopic manipulator 1. Thus, the telescopic manipulator gets extended for a length enough to compensate for the deviation of the end of the manipulator 1 from the face, which makes it possible to drill the holes whose ends are located in the some plane. The horizontal position of the feed is retained by means of the hydraulic cylinder 9 (FIG. 10). Upon feeding the oil into the rod-piston space *l* of the hydraulic cylinder 12, the telescopic manipulator 1 turns clockwise and it gets shorter correspondingly.

When operating in the face, conditions may arise which require not only an automatic but also an independent control of the manipulator length and its vertical swivel. An example is found under conditions which require the change of the length of the telescopic manipulator irrespective of its angle of elevation or vertical swivel of the drilling boom, with the telescopic manipulator length unchanged.

Provision of an independent control of both the length of the telescopic manipulator and its vertical swivel is attained in the herein-proposed construction of the drilling boom by virtue of the servopistons available on the control desk (not shown) and the springs 140 and 141 in the servopiston 95, due to which the plunger displacement is relatively inconsiderable during lengthy displacement of the servopiston body.

An independent control of operation can occur only when the servopiston of the servomechanism drive 15*a* is disconnected from the oil line. In order to operate in an independent control mode, the distributor 163 (located on the control desk) for feeding the working fluid to the servopiston 95 of the servomechanism drive 15*a* is turned off. Disconnection of the servopiston 95 from the oil line results in swivelling the telescopic manipulator 1 which causes the servopiston 95 to displace with respect to the plunger 132, and thus the telescopic manipulator remains retracted. With the drilling boom operating in an independent control mode, the telescopic manipulator is swivelled by means of the distributor 159 located on the control desk.

The oil is fed to a space *k* of the hydraulic cylinder 12 by means of the distributor 159. As a result, the rod 55 extends and causes the telescopic manipulator 1 to turn counterclockwise with respect to the pier column 2. The slide block 21 makes up along the guideways 20 and urges the drive 15*a* together with the body 94 of the servopiston 95 to displace with respect to the plunger 132 till the butt end of the plunger 132 gets in contact with the butt end of the rod 93 after which the body 94 of the servopiston 95 continues to displace towards the bracket 89 together with the plunger 132 whose collar 139 also displaces the shaped washer 143 towards the bracket 89, thereby compressing the spring 141.

Upon feeding the oil into the rod-end space *l* of the hydraulic cylinder 12 (FIG. 10), the telescopic manipulator 1 turns clockwise.

When operating in an independent control mode, the telescopic manipulator 1 is extended by actuating the distributor 162 (FIG. 10) located on the control desk. As a result, the oil is fed through the distributor into the piston-end space *f* of the hydraulic cylinder 8 whose rod 25 gets extended, thus increasing the length of the telescopic manipulator 1. The oil expelled from the rod-end space *g* is fed through the hydraulic pipeline 160 into the rod-end space *i* of the hydraulic cylinder 90 and urges the rod 93 together with the body 94 of the servopiston 95 and the plunger 132 to displace towards the bracket 88, thus compressing the left-hand spring 140 (FIG. 9). As a result, the space *h* of the hydraulic cylinder 90 (FIG. 10) of the servomechanism 15*a* gets communicated with the return line through the distributor 162.

Upon retracting the telescopic manipulator the oil is fed through the distributor 162 into the piston-end space *h* of the hydraulic cylinder 90. As a result, the rod 93 together with the body 94 of the servopiston 95 and the plunger 132 displaces towards the bracket 89, thus compressing the right-hand spring 141 (FIG. 9). The oil expelled from the rod-end space *i* is fed through the hydraulic cylinder 160 into the rod-end space *g* of the hydraulic cylinder 8. As a result, the rod 25 retracts into the hydraulic cylinder 8, thus decreasing the length of the telescopic manipulator 1.

When changing over from an independent control of operation to an automatic one, the oil is fed through the distributor 163, and the servopiston 95 of the servomechanism drive 15*a* into the actuating cylinder 8. As a result, the springs 140 and 141 of the servopiston 95 are set to the initial position, i.e., when the telescopic manipulator length corresponds to the angle of turn of said manipulator.

The drive 15*a* of the servomechanism 15 coupled with the actuating hydraulic cylinder 8 of the telescopic manipulator 1 and the drive 17*a* of the servomechanism 17 coupled with the crowd hydraulic cylinder 6 of the feed 4 are similar in design, therefore when discussing the operation of the servomechanism 17, reference is directed to the constructional units as shown in FIGS. 8 and 9 and to the reference numerals specified in the accompanying drawings.

The servomechanism 17 (FIG. 3) is coupled with the crowd hydraulic cylinder 6 of the feed 4. A horizontal turning of the telescopic manipulator 1 causes the lever 157 together with the pier column 2 to turn, which results in that the tie rod 155 moves and in turn pulls the body 153 of the hydraulic cylinder 152 of the drive 17*a*.

While displacing along the rod 150, the servomechanism drive urges to move the body of the servopiston 151. As a result, oil from the oil line (not shown) is fed through the duct 133 (FIG. 9) into the duct 135 and to the piston-end space *f* or to the rod-end space *g* of the crowd hydraulic cylinder 6 of the feed 4, or to the piston-end space *h* or to the rod-end space *i* of the hydraulic cylinder 152 of the drive 17*a* of the servomechanism 17.

The above-disclosed constructional arrangement of the drilling boom enables it to operate both on an automatic cycle and in an independent control mode. This considerably extends the capabilities of the present drilling boom.

What we claim is:

1. A drilling boom, comprising: a telescopic manipulator whose one end is hinged to a pier column mounted on a bearing plate with a possibility to turn round a vertical axis; a telescopic manipulator actuating hydraulic cylinder housed in said manipulator; a feed with a drifter hinged to the vacant end of said telescopic manipulator with a possibility to move axially either towards or away from the face, a crowd hydraulic cylinder of said feed, mounted on the vacant end of said telescopic manipulator and adapted to crowd said feed either towards or away from the face; a head rigidly secured on the vacant end of said telescopic manipulator and adapted to carry hydraulic cylinders for tilting and turning said feed with drifter in a horizontal plane as well as a rotational mechanism adapted to turn said feed round the axis of said rotational mechanism, which axis is parallel to that of the feed; a hydraulic cylinder adapted for lifting said telescopic manipulator, one end of said hydraulic cylinder being hinged to said telescopic manipulator, while its other end is hinged to said pier column; a hydraulic cylinder adapted to turn said telescopic manipulator in a horizontal plane and hinged with its one end to said bearing plate, and with its other end, to said pier column; a servomechanism adapted to control the operation of said telescopic manipulator actuating hydraulic cylinder and provided with a drive having a cylinder secured on said telescopic manipulator and a link motion kinematically coupling said drive of the servomechanism with said telescopic manipulator and comprising guideways rigidly secured on said pier column and a slide block mounted in said guideways and rigidly fixed to the body of said servomechanism drive hydraulic cylinder; said servomechanism drive incorporates a rod, coaxially mounted on which are: a hydraulic cylinder whose rod-end or piston-end space communicates with the respective rod-end space or piston-end space of said telescopic manipulator actuating hydraulic cylinder, said spaces being equal in volume; a servopiston rigidly connected with the rod of said servomechanism drive hydraulic cylinder, said servomechanism controlling the operation of said telescopic manipulator actuating hydraulic cylinder, said servopiston having a body with a duct to feed working fluid into said servopiston; ducts to feed the working fluid into the respective piston-end space or rod-end space of said servomechanism hydraulic cylinder, or into the respective piston-end space or rod-end space of said telescopic manipulator actuating hydraulic cylinder; ducts to return the working fluid from said spaces and a plunger located inside said servopiston body and rigidly secured on said rod; depending on the position of said servopiston body with respect to said plunger, one of said ducts for feeding the working fluid into said servomechanism drive hydraulic cylinder or said telescopic manipulator actuating hydraulic cylinder communicating with a duct for feeding the working fluid into said servopiston, while the other duct communicating with one of the ducts adapted to return the working fluid; as a result, the vertical swivelling of said telescopic manipulator causes said body of the servomechanism drive hydraulic cylinder with its rod and together with the body of said servopiston, to move with respect to said plunger, thus communicating the duct for feeding the working fluid into said servopiston with one of the spaces of said telescopic manipulator actuating hydraulic cylinder, either extending or retracting its rod and, thereby compensating for deviation of the feed business end from the face.

2. A drilling boom, comprising: a telescopic manipulator whose one end is hinged to a pier column mounted on a bearing plate with a possibility to turn round a vertical axis; a telescopic manipulator actuating hydraulic cylinder housed in said manipulator; a feed with a drifter hinged to the vacant end of said telescopic manipulator with a possibility to move axially either towards or away from the face; a crowd hydraulic cylinder of said feed, mounted on the vacant end of said telescopic manipulator and adapted to crowd said feed either towards or away from the face; a head rigidly secured on the vacant end of said telescopic manipulator and adapted to carry hydraulic cylinders for tilting and turning said feed with drifter in a horizontal plane and a rotational mechanism adapted to turn said feed round the axis of said rotational mechanism, which axis is parallel to that of the feed; a hydraulic cylinder adapted for lifting said telescopic manipulator, one end of said hydraulic cylinder being hinged to said telescopic manipulator, while its other end is hinged to said pier column; a hydraulic cylinder adapted to turn said telescopic manipulator in a horizontal plane and hinged with one end to said bearing plate and with its other end, to said pier column; a servomechanism adapted to control the operation of said feed crowd hydraulic cylinder and provided with a drive having a hydraulic cylinder secured on said bearing plate, and a link motion kinematically coupling said drive of the servomechanism with said telescopic manipulator and comprising a tie rod hinged to the body of said servomechanism drive hydraulic cylinder, and a lever hinged to said tie rod and secured on said pier column, said servomechanism drive incorporating a rod coaxially mounted on which are: a hydraulic cylinder whose rod-end space or piston end space communicates with the respective rod-end or piston-end space of the feed crowd hydraulic cylinder, said spaces being equal in volume; a servopiston rigidly connected with the rod of said servomechanism drive hydraulic cylinder, said servomechanism controlling the operation of said feed crowd hydraulic cylinder, said servopiston having a body with a duct to feed the working fluid into the respective piston-end space or rod-end space of said servomechanism hydraulic cylinder or into the respective piston-end space or the rod-end space of said feed crowd hydraulic cylinder and ducts for returning the working fluid from said spaces and a plunger located inside said servopiston body and rigidly secured on said rod; depending on the position of said servopiston body with respect to said plunger, one of said ducts for feeding the working fluid into said servomechanism drive hydraulic cylinder or into said feed crowd hydraulic cylinder communicating a duct for feeding the working fluid into said servopiston while the other of said ducts communicating one of the return line ducts; as a result, the vertical swivelling of said telescopic manipulator causes said body of the servomechanism drive hydraulic cylinder with its rod and together with the body of said servopiston, to move with respect to said plunger, thus communicating the duct for feeding the working fluid into said servopiston with one of the spaces of said feed crowd hydraulic cylinder, either extending or retracting its rod and thus compensating for a deviation of the feed business end from the face.

3. A drilling boom, comprising: a telescopic manipulator whose one end is hinged to a pier column mounted on a bearing plate with a possibility to turn round a vertical axis; a telescopic manipulator actuating hydraulic cylinder housed in said manipulator; a feed with a drifter hinged to the vacant end of said telescopic manipulator with a possibility to move axially either towards or away from the face; a crowd hydraulic cylinder of said feed, mounted on the vacant end of said telescopic manipulator and adapted to crowd said feed either towards or away from the face; a head rigidly secured on the vacant end of said telescopic manipulator and adapted to carry hydraulic cylinders for tilting and turning said feed with drifter in a horizontal plane, and a rotational mechanism adapted to turn said feed round the axis of said rotational mechanism, which axis is parallel to that of the feed; a hydraulic cylinder adapted for lifting said telescopic manipulator, one end of said hydraulic cylinder being hinged to said telescopic manipulator, while its other end is hinged to said pier column; a hydraulic cylinder adapted to turn said telescopic manipulator in a horizontal plane and hinged with its one end to said bearing plate, and with its other end, to said pier column; a servomechanism adapted to control the operation of said telescopic manipulator actuating hydraulic cylinder and provided with a drive having a hydraulic cylinder secured on said telescopic manipulator and a link motion kinematically coupling said drive of the servomechanism with said telescopic manipulator, and comprising guideways rigidly secured on said pier column and a slide block mounted in said guideways and rigidly fixed to the body of said servomechanism drive hydraulic cylinder; a servomechanism adapted for controlling the operation of said feed crowd hydraulic cylinder and provided with a drive having a hydraulic cylinder secured on said bearing plate, and a link motion kinematically coupling said servomechanism drive with said telescopic manipulator and comprising a tie rod hinged to the body of said servomechanism drive hydraulic cylinder and a lever hinged to said tie rod secured on said pier column, said servomechanisms each having a similar drive, incorporating a rod coaxially mounted on which are: a hydraulic cylinder whose rod-end space or piston-end space communicates with the respective rod-end space or piston-end space of said telescopic manipulator actuating hydraulic cylinder or said feed crowd hydraulic cylinder, said spaces being equal in volume; a servopiston rigidly connected with the rod of said servomechanism drive hydraulic cylinder, said servomechanism controlling the operation of said telescopic manipulator actuating hydraulic cylinder and said feed crowd hydraulic cylinder, said servopiston having a body with a duct to feed to working fluid into said servopiston, ducts to feed the working fluid into the respective piston-end space o rod-end space of said servomechanism hydraulic cylinders or into the piston-end spaces or rod-end spaces of said telescopic manipulator actuating cylinder or said feed crowd hydraulic cylinder, and ducts for returning the working fluid from said spaces, and a plunger located inside said servopiston body and rigidly secured on said rod; depending on the position of said servopiston body with respect to the plunger, one of said ducts for feeding the working fluid into said servomechanism drive hydraulic cylinder, said telescopic manipulator actuating hydraulic cylinder or said feed crowd hydraulic cylinder, being communicated with a duct for feeding the working fluid into said servopiston, while the other duct is communicated with one of the return line ducts; as a result, the vertical swivelling of said telescopic manipulator causes the body of said servomechanism drive hydraulic cylinder with its rod and together with the body of said servopiston, to move with respect to said plunger, thus communicating the duct for feeding the working fluid into said servopiston with one of the spaces of said telescopic manipulator actuating hydraulic cylinder, thus either extending or retracting its rod and compensating for a deviation of the feed business end from the face; simultaneously with this, a horizontal motion of said telescopic manipulator results in the displacement of the body of said servomechanism drive hydraulic cylinder with its rod and together with the body of said servopiston with respect to said plunger, thus communicating the duct for feeding the working fluid into said servopiston with one of the spaces of said feed crowd hydraulic cylinder, thus either extending or retracting its rod and compensating for a deviation of the feed business end from the face.

* * * * *